US009567850B2

(12) United States Patent
Prill et al.

(10) Patent No.: US 9,567,850 B2
(45) Date of Patent: Feb. 14, 2017

(54) SYSTEM OF MONITORING ROTATIONAL TIME OF ROTATABLE EQUIPMENT

(75) Inventors: Jonathan R. Prill, Edmonton (CA); Michael X. Tang, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 1591 days.

(21) Appl. No.: 12/364,581

(22) Filed: Feb. 3, 2009

(65) Prior Publication Data

US 2009/0205869 A1 Aug. 20, 2009

Related U.S. Application Data

(60) Provisional application No. 61/029,000, filed on Feb. 15, 2008.

(51) Int. Cl.
*E21B 47/12* (2012.01)
*E21B 4/02* (2006.01)

(52) U.S. Cl.
CPC ..... *E21B 47/124* (2013.01); *E21B 4/02* (2013.01)

(58) Field of Classification Search
USPC ..... 175/40, 45, 56, 61, 62, 92, 107; 166/66, 166/250.01
See application file for complete search history.

(56) References Cited

U.S. PATENT DOCUMENTS

| | | | | |
|---|---|---|---|---|
| RE31,222 | E * | 4/1983 | McCracken | 702/6 |
| 4,647,853 | A | 3/1987 | Cobern | |
| 5,358,059 | A | 10/1994 | Ho | |
| 5,450,751 | A * | 9/1995 | Putty et al. | 73/504.18 |
| 5,679,894 | A * | 10/1997 | Kruger et al. | 73/152.03 |
| 6,142,228 | A | 11/2000 | Jogi | |
| 6,206,108 | B1 * | 3/2001 | MacDonald et al. | 175/24 |
| 6,267,185 | B1 | 7/2001 | Mougel | |
| 6,540,032 | B1 * | 4/2003 | Krueger | 175/40 |
| 2002/0185315 | A1 * | 12/2002 | McLoughlin et al. | 175/76 |
| 2003/0111268 | A1 * | 6/2003 | Alft et al. | 175/73 |
| 2005/0001737 | A1 * | 1/2005 | Baron et al. | 340/854.4 |
| 2007/0094055 | A1 * | 4/2007 | Nakayama et al. | 705/5 |

OTHER PUBLICATIONS

PCT International Search Report for International Application No. PCT/US2009/032962 filed Feb. 3, 2009.

* cited by examiner

*Primary Examiner* — David Bagnell
*Assistant Examiner* — Ronald Runyan
(74) *Attorney, Agent, or Firm* — Conley Rose, P.C.

(57) ABSTRACT

A system for monitoring rotational time of a rotational equipment. At least some of the illustrative embodiments are systems comprising a rotatable equipment, a sensor, and an electronic system. The sensor is coupled to the rotatable equipment, and is configured to sense rotation of the rotatable equipment. The electronic system is electrically couple to the sensor. The electronic system is self-contained, and is configured to power the sensor to determine rotational time of the rotatable equipment.

19 Claims, 3 Drawing Sheets

SYSTEM OF MONITORING ROTATIONAL TIME OF ROTATABLE EQUIPMENT

BACKGROUND

In drilling a borehole in the earth, such as in exploration and recovery of hydrocarbons, a drill bit is connected on the lower end of an assembly of drill pipe sections connected end-to-end to form a "drill string". In some cases the drill string and bit are rotated by a drilling table at the surface, and in other cases the drill bit may be rotated by a downhole motor within the drill string above the bit, while remaining portions of the drill string remain stationary. In most cases, the downhole motor is a progressive cavity motor that derives power from drilling fluid (sometimes referred to as "mud") pumped from the surface, through the drill string, and then through the motor (hence the motor may also be referred to as a "mud motor").

It is common in the drilling industry to rent downhole equipment, such as mud motors, with the agreement that the billable time will be the total accumulated operating time of the motor. While in most cases the drilling operators correctly report total accumulated operating time, in some cases the operating time is under-reported.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, drilling equipment companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections.

"Rotary drilling" shall mean that the entire drill string is rotating from the surface.

"Slide drilling" shall mean that only the drill bit and other components in the lower portions of the drill string below the Mud Motor are rotating and the upper portions of the drill string are not rotating.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments were developed in the context of a stand-alone, self powered system and method to accumulate rotational time of a downhole progressive cavity motor (mud motor), and will be described in that context; however, the systems and methods find applicability for other rotatable equipment, such as electric motors, and thus the developmental context should not be construed as a limitation as the breadth of the applicability of the systems and methods described herein.

Figure 1:
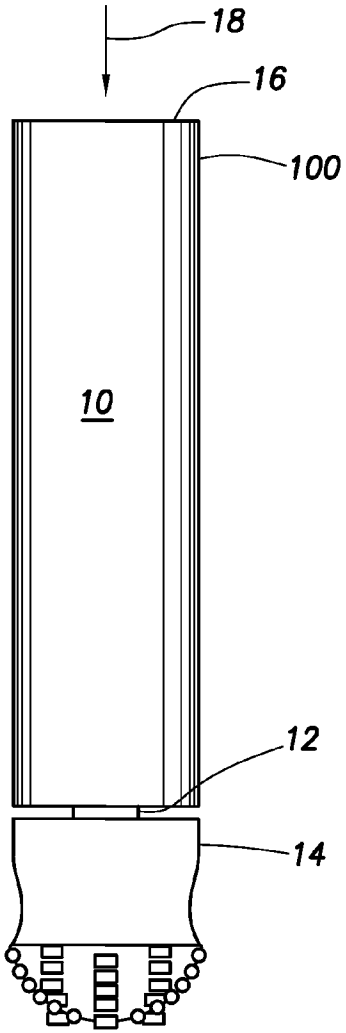
FIG. 1 shows a mud motor in accordance with at least some embodiments.

FIG. 1 shows a mud motor 100 in accordance with at least some embodiments. In particular, FIG. 1 shows that the mud motor 100 has a tool body 10 and an output shaft 12. The output shaft 12 couples to a drill bit 14 of any suitable type. The upper end 16 of the mud motor 100 is configured to couple to drill pipe in the drill string. Drilling fluid (or "mud") is pumped from the surface, through the drill pipe, and through the mud motor 100 as illustrated by arrow 18. The drilling fluid turns an internal rotor of the mud motor 100, which rotates the output shaft 12 and the drill bit 14. The drilling fluid, after passing through the mud motor 100, exits through jets in the drill bit 14, and returns to the surface through the annular space between the drilling string and the borehole wall.

Figure 2:
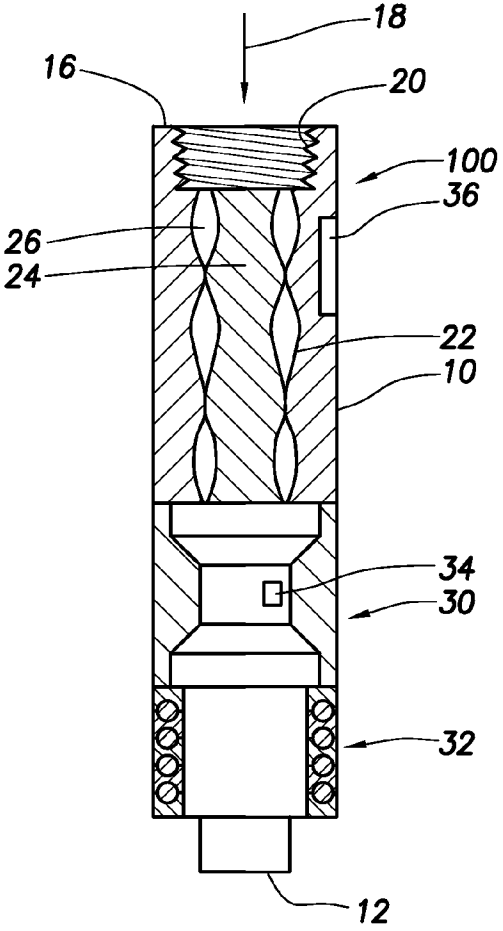
FIG. 2 shows a cross-sectional view of a mud motor in accordance with at least some embodiments.

FIG. 2 shows a simplified cross-sectional view of the mud motor 100. In particular, the upper end 16 the mud motor 100 comprises internal threads 20 along the inside diameter of the upper end 16. The threads 20 enable the mud motor 100 to couple to drill pipe sections, or possibly other downhole devices such as measuring-while-drilling and/or logging-while-drilling tools. The mud motor 100 further comprises a stator portion 22 and a rotor portion 24. The spaces between the stator and rotor form cavities, for example cavity 26. Drilling fluid enters the mud motor 100 in the direction indicated by arrow 18, and the drilling fluid moves between the stator 22 and rotor 24 in the cavities 26. Each cavity 26 filled with drilling fluid progresses down the mud motor 100 as the rotor 24 turns, hence the phraseology "progressive cavity motor". The rotational energy of the rotor 24 caused by the drilling fluid moving between the stator 22 and rotor 24 is then transferred to transmission section 30. Finally, the rotational energy passes through a bearing section 32, which absorbs the high forces associated with drilling, and then to the output shaft 12.

In order to monitor and accumulate the amount of time mud motor 100 is in operation, in some embodiments a sensor 34 is mechanically coupled to a rotatable portion of the mud motor 100. In FIG. 2, the sensor 34 is shown coupled to a portion of the rotor 24 within the transmission 30, but the sensor 34 may be coupled to, or in operational relationship with, any rotatable portion of the mud motor 100. In some embodiments the sensor 34 electrically couples to an electronic system 36, illustrated in FIG. 2 as being embedded in the body 10 proximate to the stator 22 of the mud motor 100. In other embodiments, the electronic system 36 may be placed in any suitable location on and/or within the mud motor 100. Because of temperature, pressure and vibration encountered downhole, the electronic system 36 may reside within a protective casing to protect the components from the environmental factors. In some embodiments, the sensor 34 electrically couples to the electronic system 36 by way of slip rings, and in other embodiments the sensor 34 wirelessly couples to the electronic system 36 (e.g., IEEE 802.11, or BLUETOOTH®).

In at least some embodiments, the electronic system 36 and sensor 34 are an independent system over which the drilling company renting the mud motor 100 has no control. The electronic system 36 is self-contained, and is capable of monitoring and accumulating rotating usage time based on internally derived power (e.g., from a battery). For example, the electronic system 34 may be operational to accumulate usage time over the course of weeks or months. Once the mud motor 100 is returned by the drilling company to the owner, the owner may access the electronic system 34 and obtain a report of rotational time of the mud motor since leaving possession of the owner. The drilling company's reported usage time may then be compared to the usage time accumulated by the electronic system 36, and appropriate billing action taken.

Figure 3:
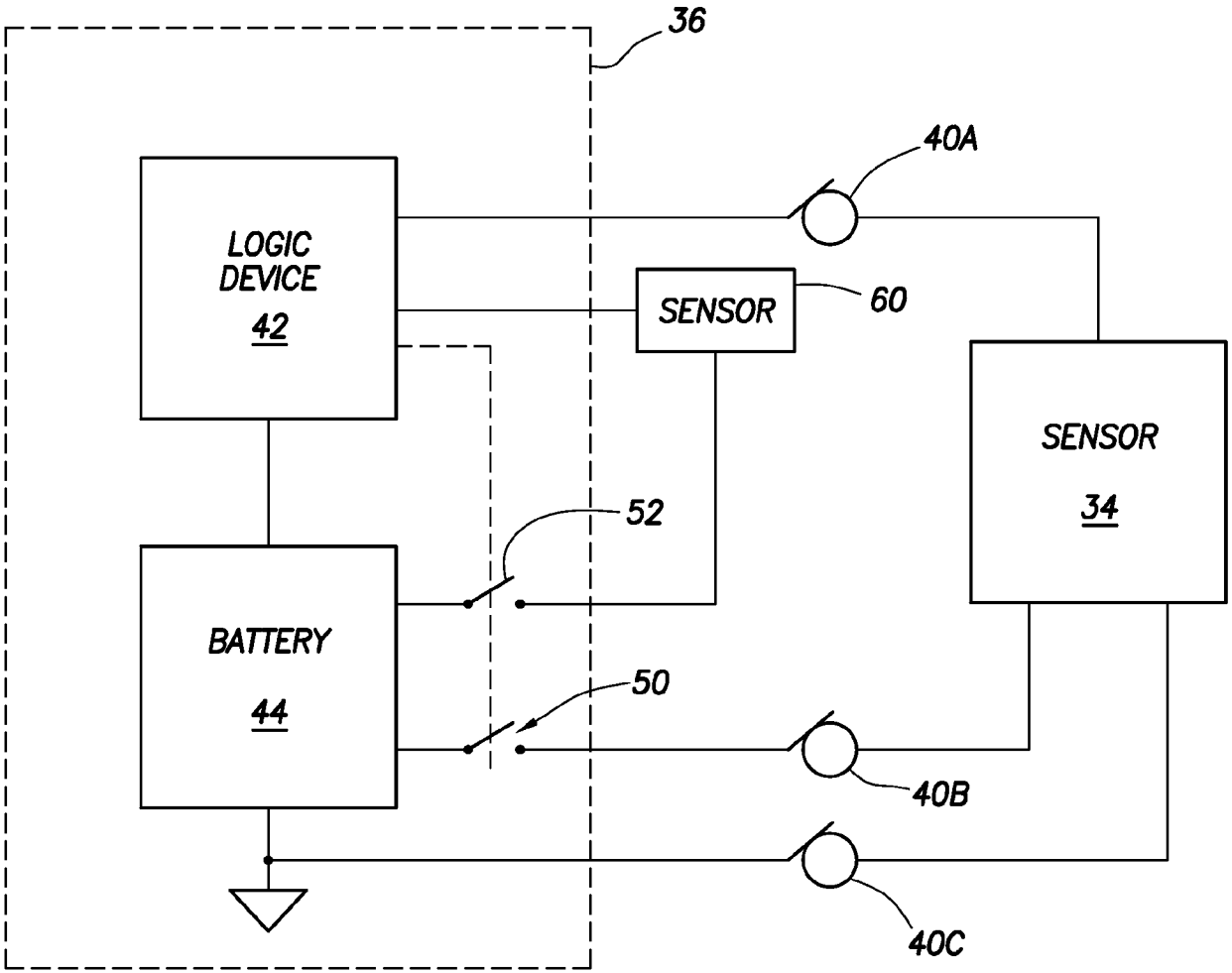
FIG. 3 shows a block diagram of a system in accordance with at least some embodiments.

FIG. 3 shows the electronic system 36 coupled to the sensor 34. In particular, in some embodiments the various electrical signals used by the sensor 34 couple from the electronic system 36 to the sensor 34 by way of slip rings 40. Within the electronic system 34 resides a logic device 42 and a battery 44. In some embodiments, the logic device 42 is microcontroller, thus having onboard random access memory (RAM), read only memory (ROM) and input/output (I/O) ports. In other embodiments, the functionality may be implemented by a standalone logic device and an external RAM, ROM and I/O components. In at least some embodiments, the logic device 42 is a microcontroller. Both the logic device 42 and sensor 34 couple to the battery 44, of any suitable type.

While it may be possible to have the logic device 42 and sensor 34 continuously active and monitoring for rotation of the mud motor, in order to reduce the power requirements of the battery 44 (and also the size), in some embodiments the sensor 34 and electronic system 36 operate in a low power state. Periodically (e.g., every fifteen minutes), the logic device 42 exits the low power state, activates the sensor 34, makes a determination as to whether the rotor 24 is turning, stores the information, and again enters the low power state. In particular, logic device 42 may couple to battery 44 continuously, but the amount of power drawn during the low power state is small compared to fully operational state of the logic device 42. In yet other embodiments, the logic device 42 may not be coupled to the battery 44, thus drawing no energy from battery 44.

Once the lower power state is exited, the logic device 42 may power the sensor 34 by operation of switch 50, make the determination as to whether the rotor 24 is turning, open switch 50, and re-enter the lower power state. Switch 50 may take many forms. In some embodiments, switch 50 is mechanical or solid state relay. In yet still other embodiments, switch 50 may be transistor (e.g., bipolar junction or field effect) operated as a switch.

Likewise, sensor 34 may take many forms. In some embodiments, sensor 34 is tachometer (e.g., Hall effect type) that measures revolutions of the rotor with respect to the stator (in which case the sensor may be placed on the stator, obviating the need for slip rings). In yet still other embodiments, sensor 34 is an angular rate sensor, for example a solid-state, silicon-based gyroscope. Such a gyroscope is configurable to detect angular rates of the device to which the gyroscope is attached. Thus, when the logic device 42 periodically exits the low power state and powers the sensor 34, the logic device 42 determines rotational state of the rotor 24 based on the angular rate of the rotor 24.

As mentioned above, in some embodiments the electronic system 36 powers the sensor 34 periodically. Consider, for the purpose of explanation, that the sensor 34 is powered a plurality of times (e.g., four times) an hour. If each time the sensor 34 is powered over the course of an hour rotation is sensed by the sensor 34, then the logic device 42 and/or a person who receives the report from the logic device 42, may assume the mud motor 100 was operational over the entire hour. In some embodiments, when the sensor 34 senses rotation, the sensor 34 senses rotation of the rotor 24 relative to the stator 22. In other embodiments, the sensor 34 may sense rotation of the stator 22 relative to the borehole. If rotation is not sensed during one or more times over the illustrative hour, then the logic device 42 and/or the person who receives the report from the logic device, may assume the mud motor 100 was operational less than the entire hour. In particular, the mud motor 100 was operational in proportion to the number of rotating versus non-rotating determinations made.

In addition to the sensor 34 to sense rotation of the rotor 24 of the mud motor 100, some embodiments utilize additional sensors to augment the data regarding rotation. In particular, and still referring to FIG. 3, in some embodiments an additional sensor 60 may couple to the logic device 42, and to the extent the additional sensor 60 needs power, the sensor 60 may also couple to the battery 44 through switch 52 (controlled by logic device 42). In other embodiments, more than one additional sensor 60 may be coupled to the logic device 42 and the battery 44. The one or more additional sensors 60 that may be employed are many. For example, in some embodiments the additional sensor 60 is temperature sensor (e.g., thermocouple, or resistive thermal device (RTD)). Ambient temperatures experienced downhole can exceed 100° C. in some cases, and thus high sensed temperature combined with rotation of the rotor verifies downhole use. Moreover, the illustrative temperature sensor may be used to verify compliance with operating temperature ranges by the driller.

As yet another example, the additional sensor 60 could be a pressure sensor, which reads parameters such as drilling fluid pressure inside the mud motor, or drilling fluid pressure in the annular space between the drill pipe and the borehole wall. A pressure reading consistent with expected downhole pressure may be used to verify that rotational time accumulated indeed occurred in drilling situations. Yet still another example of an additional sensor 60 is an accelerometer or vibration sensor. High vibration is typically experienced during the drilling process, and thus vibration readings may be used to verify that rotational time accumulated indeed occurred in drilling situations.

Figure 4:
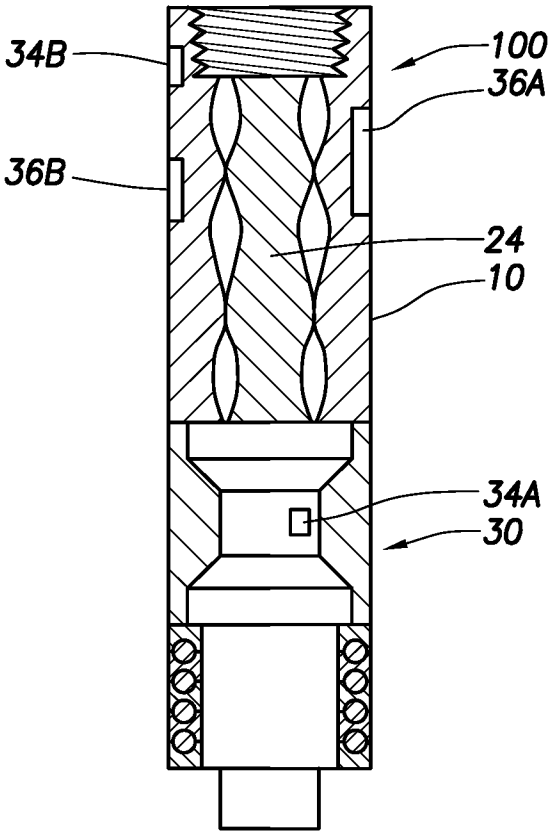
FIG. 4 shows an alternative embodiment of the mud motor.

In some cases, the owner of the mud motor 100 may wish to charge according to the method of drilling performed by the drilling company. For example, the owner of the mud motor 100 may want to charge a different rate for rotary drilling then for slide drilling. FIG. 4 shows an embodiment of a mud motor 100 configured to monitor and accumulate the amount of time the mud motor 100 was used for rotary drilling and/or slide drilling. In particular, FIG. 4 shows that the mud motor 100 has two sensors 34A-34B and two electronic systems 36A-36B. In the particular embodiment, the sensor 34A is coupled to a portion of the rotor 24 within the transmission 30, and the sensor 34A electrically coupled to the electronic system 36A embedded in the body 10 of the mud motor 100. The sensor 34B is coupled to the outer surface of the tool body 10, and the sensor 34B is electrically coupled to the electronic system 36B also disposed on the outer surface of the tool body 10. In some embodiments, the sensor 34B and the electronic system 36B may be placed in a recess on the outer surface of the tool body 10.

In some embodiments, sensors 34A-34B are the same, and the sensors 34A-34B sense rotation of a rotatable equipment. In order to protect against temperature, pressure and vibration encountered downhole, the electronic system 36A-36B may reside within a protective casing. In alternative embodiments, the electronic system 36B may be placed in any suitable location on and/or within the mud motor 100. In yet still other embodiments, the sensor 34A and the sensor 34B may couple to a single electronic system 36.

In the particular embodiment, each of the electronic systems 36A-36B powers the corresponding sensor 34A-34B at substantially the same time. If at time the sensors 34A-34B are powered, rotation is sensed by the sensor 34A and the sensor 34B, then the logic device and/or the person who receives the report from the logic device, may assume the mud motor 100 and the drill string coupled to the mud motor 100 were operational. Particularly, the logic device and/or the person who receives the report from the logic device may assume that the drilling company was performing rotary drilling. In the particular embodiment, sensor 34A is configured to sense rotation of the rotor relative to the stator, and sensor 34B is configured to sense the rotation of the stator relative to the borehole. If rotation is sensed by the sensor 34A, and rotation is not sensed by the sensor 34B, then the logic device and/or the person who receives the report from the logic device, may assume the mud motor 100 was operational and the drill string coupled to the mud motor 100 was not operational. Particularly, then the logic device and/or the person who receives the report from the logic device, may assume that the drilling company was performing slide drilling. In alternative embodiments, rotation is sensed by both of the sensors 34A-34B, then the logic device and/or the person who receives the report from the logic device, may assume the mud motor 100 and the drill string coupled to the mud motor 100 were operational.

Figure 5:
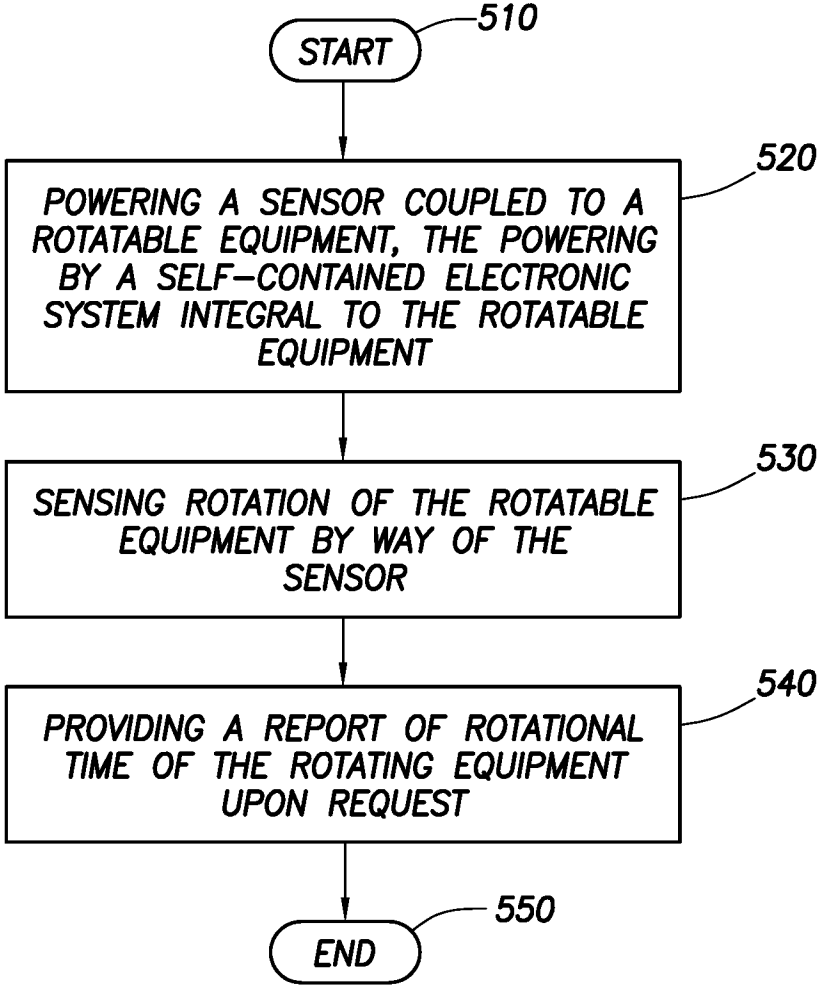
FIG. 5 shows a method in accordance with at least some embodiments.

FIG. 5 shows a method in accordance with at least some of the embodiments. In particular, the method starts (block 510) and proceeds to powering a sensor coupled to a rotatable equipment (block 520). In at least some embodiments, the sensor is periodically (e.g., approximately 15 minute intervals) powered by a self-contained electronic system integral to the rotatable equipment. Next, rotation of the rotatable equipment is sensed by way of the sensor (block 530). Finally, a report of the rotational time of the rotatable equipment is provided upon request (block 540) and the method ends (550).

The above discussion is meant to be illustrative of the principles and various embodiments of the present invention. Numerous variations and modifications will become apparent to those skilled in the art once the above disclosure is fully appreciated. For example, while the electronic system is shown coupled to the stator and the sensor is shown coupled to the rotor, in alternative embodiments the electronics and sensor could be an integrated unit (either on the same semiconductor substrate, or on different substrates yet encapsulated as a single device), and in these embodiments the electronics and sensors may all reside on the rotatable components of the mud motor. It is intended that the following claims be interpreted to embrace all such variations and modifications.

What is claimed is:

1. A downhole tool comprising:

a sensor comprising a solid-state silicon-based gyroscope configured to sense rotation of the downhole tool; and an electronic system electrically coupled to the sensor, said electronic system configured to power the sensor to determine rotational time of the downhole tool;

said downhole tool configured to threadingly couple to a drill string;

wherein the rotational time comprises a measurement of total accumulated rotating usage time while drilling.

2. The downhole tool of claim 1 wherein the sensor further configured to determine rotational status of rotor.

3. The downhole tool of claim 2 wherein the electronic system further configured to accumulate the rotational time of the downhole tool based on the status of the rotor, and the electronic system configured to report the accumulated rotational time.

4. The downhole tool of claim 1 wherein the sensor further configured to determine rotational status of the stator.

5. The downhole tool of claim 1 wherein the sensor is further configured to determine angular rate of the rotor.

6. The downhole tool of claim 1 wherein the electronic system is configured to periodically power the sensor.

7. The downhole tool of claim 1 further comprising a protective casing, the electronic system disposed within the protective casing and the protective casing mechanically coupled to the rotor.

8. The downhole tool of claim 1 wherein the electronic system comprises:

a battery; and a logic device electrically coupled to the battery and the logic device electrically coupled to the sensor.

9. The downhole tool of claim 1 further comprising:

said electronic system is configured to activate the sensor a plurality of times each hour; and said battery is configured to provide power to the electronic system for more than 1000 hours on a single charge.

10. The downhole tool of claim 1 wherein the electronic system is configured to determine the rotational time of the downhole tool based a ratio of a number of times rotation is sensed over a time interval to a number of times the sensor is powered over the time interval; wherein the sensor is discontinuously powered over the time interval.

11. The downhole tool of claim 1 wherein the downhole tool is a downhole mud motor.

12. The downhole tool of claim 1 further comprising at least one device selected from the group consisting of: a temperature sensor coupled to the electronic system and configured to read operating temperature of the tool; a pressure sensor coupled to the electronic system and configured to read a pressure associated with the tool; an accelerometer coupled to the electronic system and configured to read vibration associated with the tool; and wherein the electronic system is configured to determine whether rotation sensed by the sensor is rotation while drilling based on an output of the at least one device.

13. A system comprising:

a rotatable equipment;

a sensor comprising a solid-state silicon-based gyroscope coupled to the rotatable equipment, the sensor configured to sense rotation of the rotatable equipment; and an electronic system electrically coupled to the sensor, said electronic system is self-contained and said electronic system configured to power the sensor to determine rotational time of the rotatable equipment;

wherein the rotational time comprises a measurement of total accumulated rotating usage time while drilling.

14. The system of claim 13 further comprising:

said electronic system configured to periodically power the sensor to determine if the rotatable equipment is rotating during each period of the powering;

said electronic system further configured to accumulate the rotational time of the rotatable equipment in proportion to periods during which the rotatable equipment was rotating to periods during which the rotatable equipment was not rotating; and said electronic system configured to report the accumulated rotational time upon request.

15. The system of claim 13 wherein the sensor further configured to sense rotation of a rotor relative to a stator.

16. The system of claim 13 wherein the sensor further configured to sense rotation of a stator relative to a borehole.

17. The system of claim 13 wherein the sensor is further configured to determine angular rate of the rotatable equipment.

18. The system of claim 13 wherein the electronic system is configured to determine the rotational time of the rotatable equipment based on a ratio of a number of times rotation is sensed over a time interval to a number of times the sensor is powered over the time interval; wherein the sensor is discontinuously powered over the time interval.

19. The system of claim 13 wherein the rotatable equipment is at least one selected from the group consisting of: a downhole mud motor; and an electrical motor.

* * * * *